US008829318B1

(12) United States Patent
DeLaFrance

(10) Patent No.: US 8,829,318 B1
(45) Date of Patent: Sep. 9, 2014

(54) GUITAR COMPONENT SYSTEMS

(71) Applicant: Andrew T. DeLaFrance, Reno, NV (US)

(72) Inventor: Andrew T. DeLaFrance, Reno, NV (US)

( * ) Notice: Subject to any disclaimer, the term of this patent is extended or adjusted under 35 U.S.C. 154(b) by 0 days.

(21) Appl. No.: 13/963,810

(22) Filed: Aug. 9, 2013

Related U.S. Application Data

(60) Provisional application No. 61/717,537, filed on Oct. 23, 2012, provisional application No. 61/693,160, filed on Aug. 24, 2012.

(51) Int. Cl.
*G10D 3/00* (2006.01)
*G10D 1/08* (2006.01)

(52) U.S. Cl.
CPC ..... *G10D 1/085* (2013.01)
USPC ..... 84/292

(58) Field of Classification Search
USPC ..... 84/267, 290–292
See application file for complete search history.

(56) References Cited

U.S. PATENT DOCUMENTS 6,233,825 B1 5/2001 DeGroot
6,255,567 B1 7/2001 Minakuchi
7,863,507 B2 1/2011 Ayers
8,049,087 B1 11/2011 Opatik
8,217,254 B2 7/2012 Zoran et al.
8,450,593 B2 * 5/2013 Ierymenko et al. ..... 84/723
2008/0105101 A1 5/2008 Eldring

OTHER PUBLICATIONS

Liquid Metal Guitars, http://liquidmetalguitars.com/shop/m1-curvaceous-chromed-excellence, Last Accessed: Aug. 9, 2013, Date of Publication Unknown.

Tele Middel Les Paul neck solo.wmv—You Tube, http://www.youtube.com/watch?v=9iHpDC_1RXA, Last Accessed: Aug. 9, 2013, Uploaded on Oct. 13, 2010.

Wheeler, Tom, "The Dream Factory: Fender Custom Shop", Book, Published Jan. 2012, p. 75 of 591 pages, ISBN-10: 1423436989, ISBN-13: 978-1423436980, Publisher: Hal Leonard Corporation, U.S.

"1995 Abel Axe Small Strat-type body with holes", http://www.gbase.com/gear/abel-axe-small-strat-type-body-wit-1995-viole, Last Accessed: Aug. 9, 2013, Date of Publication Unknown.

* cited by examiner

*Primary Examiner* — Kimberly Lockett

(74) *Attorney, Agent, or Firm* — Lodestar Patents, PLLC; Raymond J.E. Hall

(57) ABSTRACT

A system relating to providing improved bodies for stringed instruments. The present invention is directed toward the fabrication of alloy electric-guitar bodies utilizing CNC processes.

23 Claims, 6 Drawing Sheets

GUITAR COMPONENT SYSTEMS

CROSS-REFERENCE TO RELATED APPLICATION

The present application is related to and claims priority from prior provisional application Ser. No. 61/693,160, filed Aug. 24, 2012, entitled "GUITAR COMPONENT SYSTEMS"; and, this application is related to and claims priority from prior provisional application Ser. No. 61/717,537, filed Oct. 23, 2012, entitled "GUITAR COMPONENT SYSTEMS", the contents of all of which are incorporated herein by this reference and are not admitted to be prior art with respect to the present invention by the mention in this cross-reference section.

BACKGROUND

This invention relates to providing a system for improved stringed-instrument components. More particularly, this invention relates to a system providing improved electric-guitar body construction.

Certain musical instruments, such as electric guitars and other electric stringed instruments, use magnetic transducers to convert mechanical string vibrations into electrical signals. The electrical signals are subsequently amplified with an amplification system and "played" through a loudspeaker.

Many factors influence the tonal quality of an electric stringed instrument. For example, a musician's ability to achieve a particular tonal quality depends, in part, on transducer and amplifier selection, positioning of the transducers relative to the strings, playing style, finger pressure, etc. There also exists other important factors which contribute to the overall instrument sound.

Designers of electric stringed instruments often describe the production of sound in terms of interactions of moving strings within electromagnetic fields of stationary transducers (generally referred to as "pickups"). In actuality, the pickups of most electric stringed instruments are not stationary during play; rather, most pickups vibrate measurably along with the instrument body. The more resonant the instrument body, the more vibration energy may be transferred from the body to the pickups. For this reason, the design and construction of an electric stringed instrument body must be carefully considered, as the body component discernibly influences the sound output of many instruments.

Historically, natural wood has been the most common material used to produce electric stringed instruments. Unfortunately, natural wood is relatively easily damaged by environmental factors such as moisture, impact, etc. Also, the inherent inconsistencies of natural wood can result in unexpected and undesirable performance qualities.

Improving stringed-instrument construction to overcome the above described problems, by employing alternate non-traditional materials and improved construction methodologies, would be of benefit to many.

OBJECTS AND FEATURES OF THE INVENTION

A primary object and feature of the present invention is to provide a system overcoming the above-mentioned problems.

It is a further object and feature of the present invention to provide a system of improved stringed-instrument components, which preferably utilize non-traditional materials, such as, for example light-weight metallic alloys. It is another object and feature of the present invention to provide such a system allowing for substantially exact duplication of a stringed-instrument body. It is a further object and feature of the present invention to provide such a system including embodiments possessing low weight, improved service durability, and exceptional sound production.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a stringed-instrument component system comprising: a stringed-instrument body comprising a single integrally-formed structure; wherein such single integrally-formed structure comprises a substantially-rigid body material comprising a substantially-uniform density, at least one front-body portion, spaced apart from such at least one front-body portion, at least one rear-body portion, and at least one peripheral-body portion extending between such at least one front-body portion and such at least one rear-body portion; wherein such at least one front-body portion comprises a substantially solid front panel having at least one outer side and at least one inner side; wherein such at least one inner side comprises at least one body-resonance controller structured and arranged to control excitation frequencies and amplitudes of oscillatory deflections exhibited by such substantially solid front panel when such substantially solid front panel is excited by string vibration adjacent such at least one outer side; and wherein a majority of such at least one rear-body portion is structured and arranged to pass all sound energy radiating from such single integrally-formed structure without absorption or reflectance.

Moreover, it provides such a stringed-instrument component system wherein: such at least one front-body portion, such at least one rear-body portion, and such at least one peripheral-body portion together define an internal volume of such stringed-instrument body; and such stringed-instrument body is structured and arranged to comprise an overall density, by such internal volume, at least half that of such substantially-uniform density of such substantially-rigid body material. Additionally, it provides such a stringed-instrument component system wherein such at least one body-resonance controller comprises a plurality of panel stiffeners structured and arranged to increase bending stiffness of such substantially solid front panel; the stringed-instrument component system wherein each panel stiffener of such plurality of panel stiffeners comprises a stiffener wall projecting outwardly from such at least one inner side of such substantially solid front panel. Also, it provides such a stringed-instrument component system wherein at least two stiffener walls of such plurality of panel stiffeners are configured to intersect.

In addition, it provides such a stringed-instrument component system wherein such substantially solid front panel comprises: a cross-sectional thickness of less than about ⅛ inch; and a maximum unsupported length, spanning between such stiffener walls, of about 6 inches. And, it provides such a stringed-instrument component system wherein such substantially solid front panel comprises: a cross-sectional thickness of about 1/16 inch; and a maximum unsupported length, spanning between such stiffener walls, of less than about 6 inches. Further, it provides such a stringed-instrument component system wherein each such stiffener wall comprises a minimum cross-sectional thickness of about 1/16 inch. Even further, it provides such a stringed-instrument component system wherein such stiffener walls are substantially linear.

Moreover, it provides such a stringed-instrument component system wherein such plurality of panel stiffeners comprises: a first set of such stiffener walls and a second set of such stiffener walls; wherein such stiffener walls of such first set comprise substantially parallel wall orientations; wherein such stiffener walls of such second set comprise substantially parallel wall orientations; and wherein such substantially parallel wall orientations of such second set form angles of about 90-degrees with respect to such substantially parallel wall orientations of such first set.

Additionally, it provides such a stringed-instrument component system wherein such stringed-instrument body further comprises at least one component receiver structured and arranged to receive at least one body-mountable electric-instrument component. Also, it provides such a stringed-instrument component system wherein such at least one component receiver comprises: at least one component pocket configured to accommodate portions of the at least one body-mountable electric-instrument component; and wherein such at least one component pocket comprises at least one open end co-positioned along such at least one rear portion; and located at such at least one open end, at least one removable-cover receiver structured and arranged to removably receive at least one cover.

In addition, it provides such a stringed-instrument component system wherein such stringed-instrument body further comprises at least one neck-mounting assembly structured and arranged to assist mounting of at least one stringed-instrument neck having a longitudinal neck axis. And, it provides such a stringed-instrument component system wherein such stringed-instrument body further comprises: at least one longitudinal body axis; wherein such at least one neck mounting assembly is structured and arranged to position the longitudinal neck axis of the at least one stringed-instrument neck, when mounted to such stringed-instrument body, in substantially parallel orientation with such at least one longitudinal body axis; and wherein at least one of such at least one of first set of such stiffener walls and such second set of such stiffener walls comprises a substantially parallel orientation with respect to such at least one longitudinal body axis. Further, it provides such a stringed-instrument component system wherein at least one portion of each such outwardly-projecting wall intersects such at least one rear-body portion.

Even further, it provides such a stringed-instrument component system wherein: at least one such outwardly-projecting wall of such plurality of panel stiffeners forms at least one peripheral side-wall a stringed-instrument body; and such at least one peripheral side-wall is co-positioned along such at least one peripheral-body portion. Moreover, it provides such a stringed-instrument component system wherein such substantially-rigid body material comprises rigid composition having a substantially uniform density of between about 0.5 $g/cm^3$ and about 4.5 $g/cm^3$. Additionally, it provides such a stringed-instrument component system wherein such substantially-rigid body material comprises a metallic composition.

Also, it provides such a stringed-instrument component system wherein such metallic composition comprises substantially aluminum. In addition, it provides such a stringed-instrument component system wherein such substantially solid front panel is substantially planar. And, it provides such a stringed-instrument component system wherein such at least one front-body portion and such at least one rear-body portion are spaced apart a distance of about one inch.

In accordance with another preferred embodiment hereof, this invention provides a stringed-instrument component system comprising: a stringed-instrument body comprising a single integrally-formed structure; wherein such single integrally-formed structure comprises at least one front portion, at least one rear portion spaced apart from such at least one front portion, and at least one plurality of open chambers situate between such at least one front portion and such at least one rear portion; wherein such at least one front portion comprises a substantially solid front panel; and wherein each such open chamber comprises at least one side wall extending substantially between such at least one front portion and such at least one rear portion, adjoining such at least one side wall, at least one closed end formed by at least one portion of such substantially solid front face, and at least one open end co-positioned along such at least one rear portion.

In accordance with another preferred embodiment hereof, this invention provides a method relating to the formation of a stringed-instrument body comprising the steps of: supplying a substantially-rigid material in billet form; forming within such substantially-rigid material, a single integrally-formed structure comprising a stringed-instrument body by removing selected portions of such substantially-rigid material; wherein such resulting single integrally-formed structure comprises at least one front portion, at least one rear portion spaced apart from such at least one front portion, at least one plurality of open chambers situate between such at least one front portion and such at least one rear portion; wherein such at least one front portion comprises a substantially solid front panel; and wherein each such open chamber comprises at least one side wall extending substantially between such at least one front portion and such at least one rear portion, adjoining such at least one side wall, at least one closed end formed by at least one portion of such substantially solid front face, and at least one open end co-positioned along such at least one rear portion. In accordance with preferred embodiments of the present invention, this invention provides each and every novel feature, element, combination, step and/or method disclosed or suggested by this provisional patent application.

DETAILED DESCRIPTION OF THE BEST MODES AND PREFERRED EMBODIMENTS OF THE INVENTION

Figure 1A:
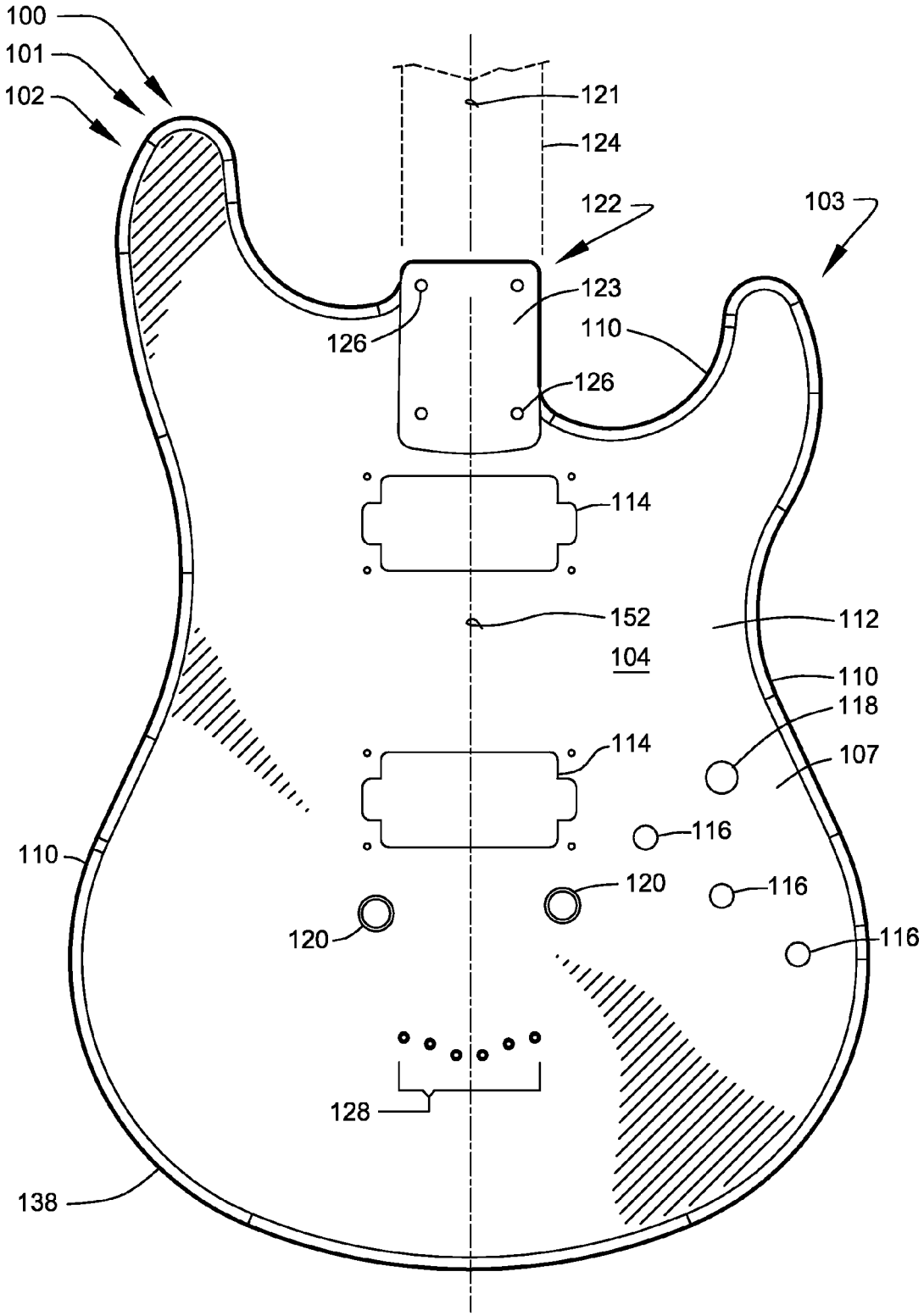
FIG. 1A shows a front view, illustrating a preferred guitar body, according to a preferred embodiment of the present invention.
Figure 1B:
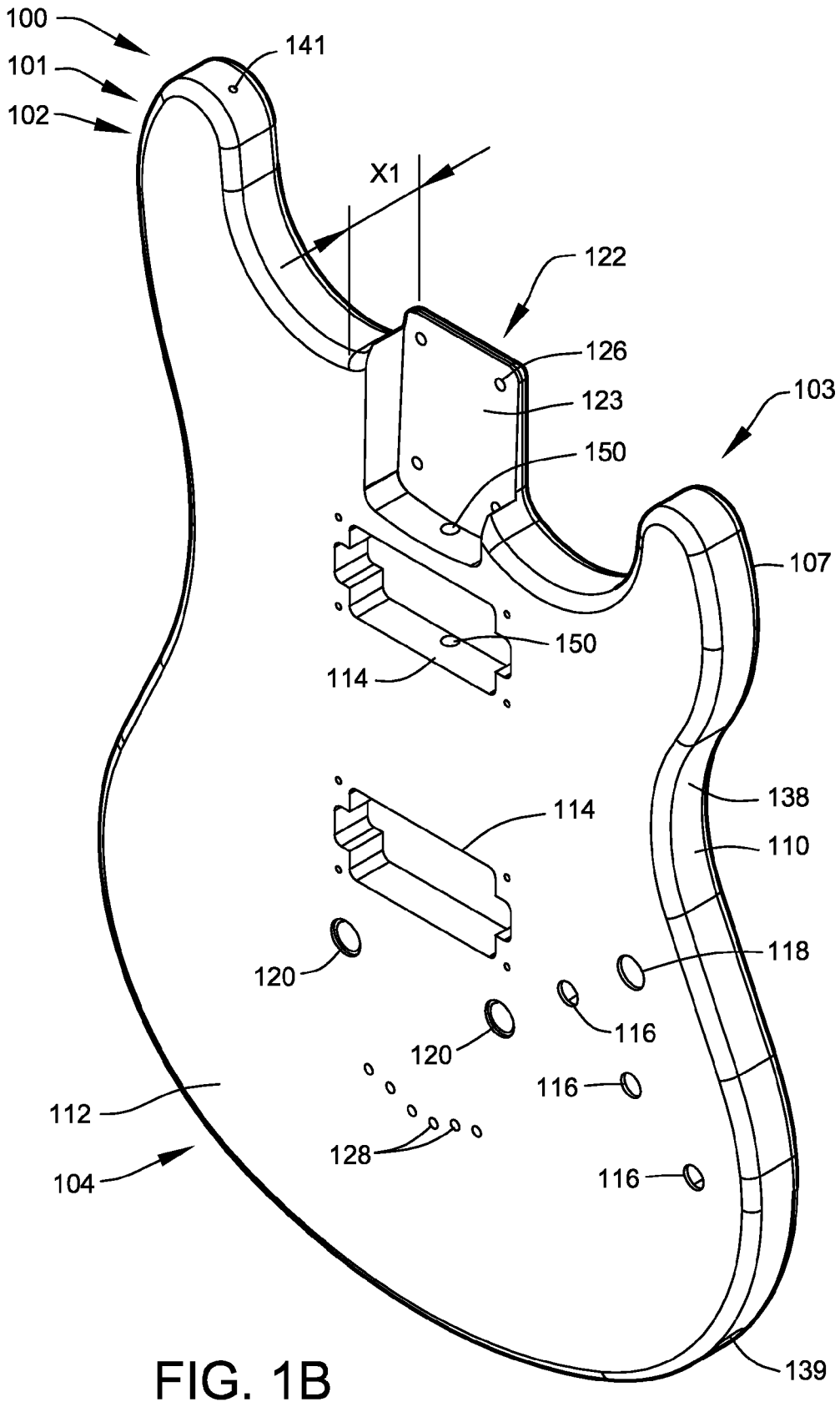
FIG. 1B shows a front perspective view, further illustrating preferred arrangements of the front portion of the guitar body, according to the preferred embodiment of FIG. 1A.

The present invention relates to a guitar-component system 100 providing improved body components for stringed instruments. Preferred embodiments of guitar-component system 100 include various stringed-instrument bodies 101, each one formed from a single constituent material as a single integral unit. Referring to the drawings, FIG. 1A shows a front view, illustrating a preferred stringed-instrument body 101. FIG. 1B shows a front perspective view, further illustrating preferred arrangements of the front portion of stringed-instrument body 101, according to the preferred embodiment of FIG. 1A. For the purpose of illustrating a highly preferred embodiment of the present system, stringed-instrument body 101 comprises an electric guitar body 102. Upon reading this specification, those with ordinary skill in the art will now appreciate that, under appropriate circumstances, considering such issues as design preference, user preferences, popularity of musical a particular style, cost, advances in musical-instrument design, etc., other electrical instrument body designs such as, for example, violins, violas, bass instruments, cellos, banjos, mandolins, sitars, etc., may suffice.

Figure 2A:
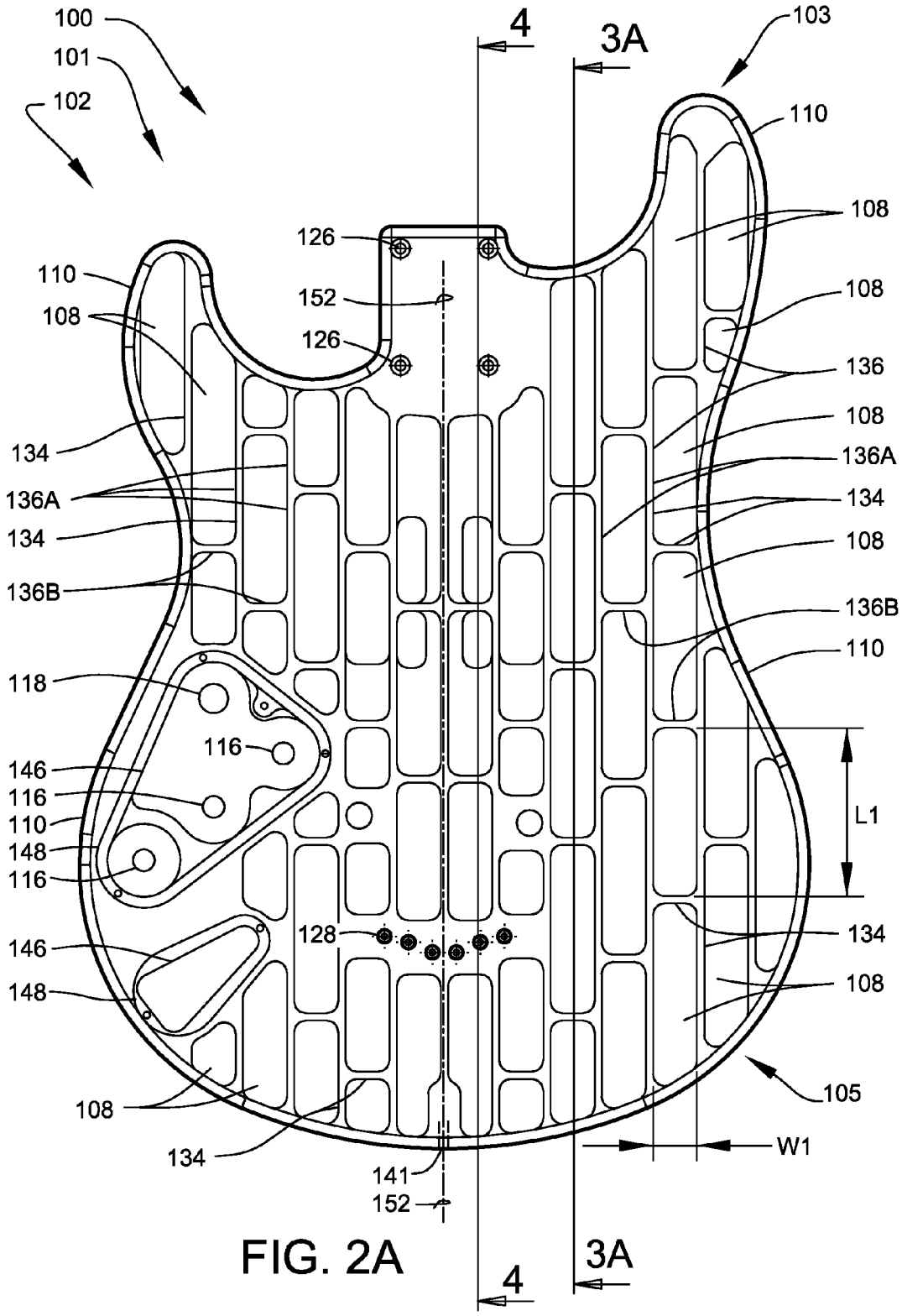
FIG. 2A shows a rear view, illustrating preferred arrangements of the rear portion of the guitar body, according to the preferred embodiment of FIG. 1A.
Figure 2B:
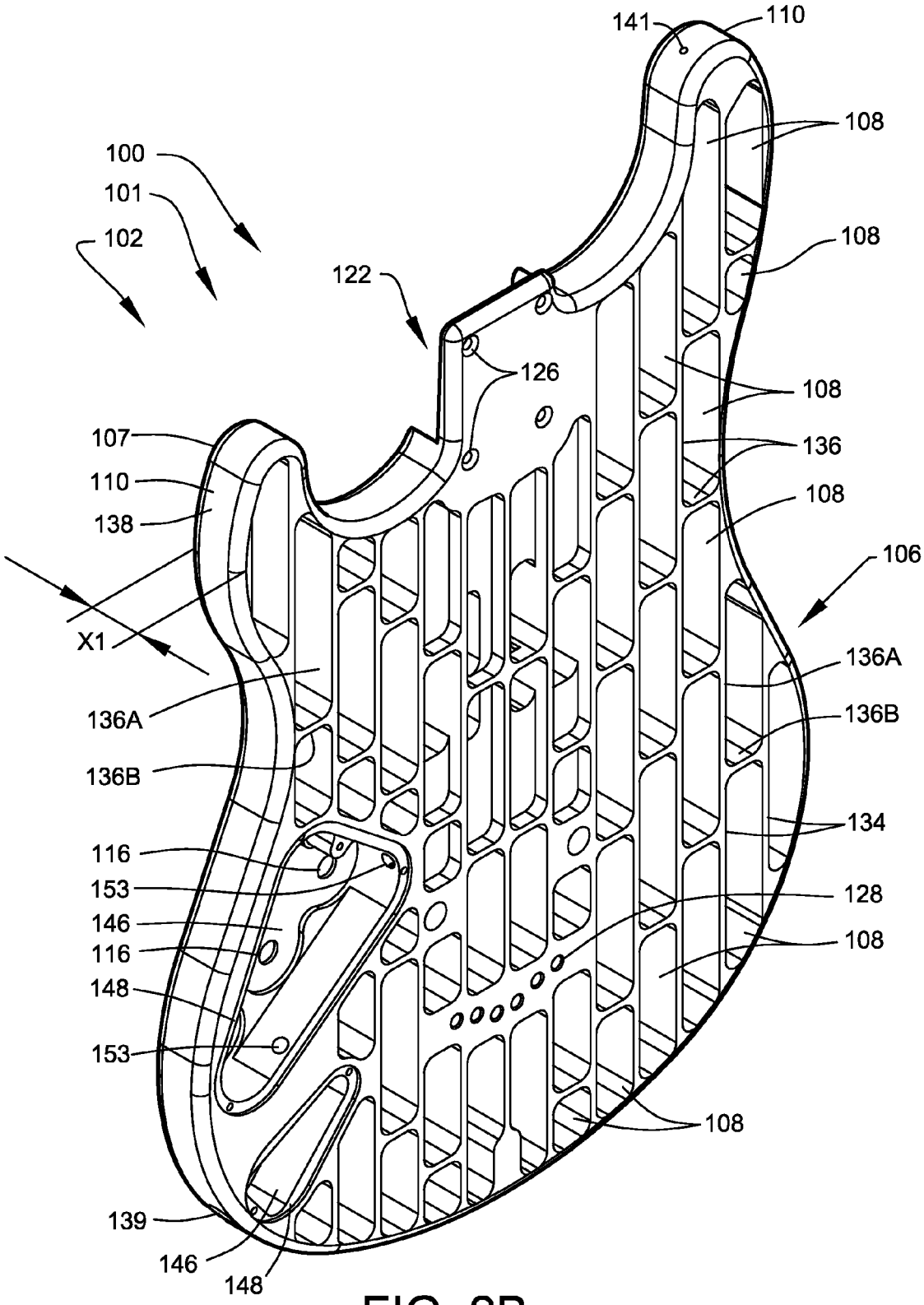
FIG. 2B shows a rear perspective view, further illustrating preferred arrangements of the rear portion of the guitar body, according to the preferred embodiment of FIG. 1A.

FIG. 2A shows a rear view, illustrating preferred arrangements of the back side of stringed-instrument body 101, according to the preferred embodiment of FIG. 1A. FIG. 2B shows a rear perspective view, further illustrating preferred arrangements of the rear portion of guitar body 102, according to the preferred embodiment of FIG. 1A.

Referring to both the front and rear-view illustrations, guitar Body 102 preferably comprises a single integrally-formed structure 103 having a fixed physical geometry. The integrally-formed structure 103 is preferably formed from a single constituent material 107. Preferred embodiments of the present system are formed from a single solid piece of material, also referred to herein as a "blank" or "billet". For the production of guitar body 102, the "blank" has a preferred thickness X1 of about one inch.

For optimal performance, substantially rigid materials of substantially-uniform density are most preferred. Preferred materials are selected from those providing both dimensional stability and rigidity. Most preferred materials comprise a rigid composition having a substantially uniform density of between about 0.5 g/cm$^3$ and about 4.5 g/cm$^3$. Preferably, guitar body 102 is constructed from one-inch thick billet of 6061-T6 aluminum alloy having a density of about 2.7 g/cm$^3$. Upon reading this specification, those with ordinary skill in the art will now appreciate that, under appropriate circumstances, considering such issues as design preference, user preferences, marketing preferences, cost, structural requirements, available materials, technological advances, etc., the use of other materials such as, for example, wood, a dense plastic, other metals (including stainless steel, titanium, nickel, and platinum), composites, etc., may suffice.

Guitar body 102 preferably is manufactured by machining, preferably utilizing at least a multi-axis computer numerically controlled (CNC) tool 250 (see FIG. 5), more preferably utilizing at least a three-axis computer numerically controlled (CNC) tool. The computer-aided designs comprise geometric data associated with the machining of specific preferred embodiments of guitar body 102, preferably including geometric data associated with the machining of the rear recessed pockets. Software control instructions for the multi-axis computer numerical controlled (CNC) machine tool are preferably derived from computer-aided designs (CAD) data. The multi-axis, computer numerical, controlled machine tool comprises at least one CNC machining technology, and the software control instructions comprise code enabling its operation. Upon reading this specification, those with ordinary skill in the art will now appreciate that, under appropriate circumstances, considering such issues as manufacturing preference, cost, structural requirements, available materials, technological advances, etc., other software/hardware arrangements such as the use of integrated design/tool control applications, producing CAD models using scanning processes, etc., may suffice. As part of the preferred machining processes, guitar body 102 is most often provided with a smooth machined outer finish. When guitar body 102 is made of an alloy material, as described above, a final anodized, coated (painted), embossed, engraved, or other surface finish is preferably applied. Upon reading this specification, those with ordinary skill in the art will now appreciate that, under appropriate circumstances, considering such issues as manufacturing preference, cost, structural requirements, available materials, technological advances, etc., other fabrication methods producing a unitary structure, such as, the use of injection molding processes, 3D printing, casting, non-automated milling, etc., may suffice.

Stringed-instrument body 101 preferably comprises a front-body portion 104, a rear-body portion 106 (preferably spaced apart from front-body portion 104 at distance X1 of about 1 inch), and a peripheral-body portion 110 extending substantially between and around front-body portion 104 and rear-body portion 106, as shown. Peripheral-body portion 110 of guitar body 102 preferably comprises a first-impression exterior-shape profile generally associated with those of a classic electric guitar. It should be noted that the preferred structures and arrangements of the present system permit many alternate body shapes to be anticipated.

Front-body portion 104, rear-body portion 106, and peripheral-body portion 110 together define an internal body volume 105. As will be described in greater detail below, stringed-instrument body 101 is preferably structured and arranged to comprise an overall density, by internal body volume 105, at least half that of substantially-uniform density of the single constituent material 107 from which the body is constructed.

In reference to the front views of FIG. 1A and FIG. 1B, front-body portion 104 of the guitar body preferably comprises a substantially solid front panel 112, as shown. The solid front panel 112 is preferably configured to co-position a substantially continuous boundary of the constituent material 107 adjacent to front-body portion 104. Front panel 112 of the present preferred embodiment is preferably planar in shape; however, alternate preferred panel configurations may comprise simple or complex contours.

Referring to the rear views of FIG. 2A and FIG. 2B, guitar body 102 departs radically from conventional guitar-body design by comprising a backless configuration, as shown. Preferred embodiments of the present system are preferably structured and arranged such that a majority of rear-body portion 106 is fully open. This highly preferred design permits all sound energy radiating from integrally-formed structure 103 to pass freely through rear-body portion 106 without absorption or reflectance.

The open rear-body portion 106 of guitar body 102 preferably comprises a distinct pattern of open recessed pockets 108, as shown. The plurality of open recessed pockets 108 are preferably formed by an arrangement of integrally-formed panel stiffeners 134 placed at predetermined locations and intervals, as shown. This preferred arrangement functions to reduce the overall weight of the body component while maintaining required structural strength. In addition, this preferred arrangement of reinforcing stiffeners functions to control resonance within the integrally-formed structure 103 of guitar body 102.

Figure 3A:
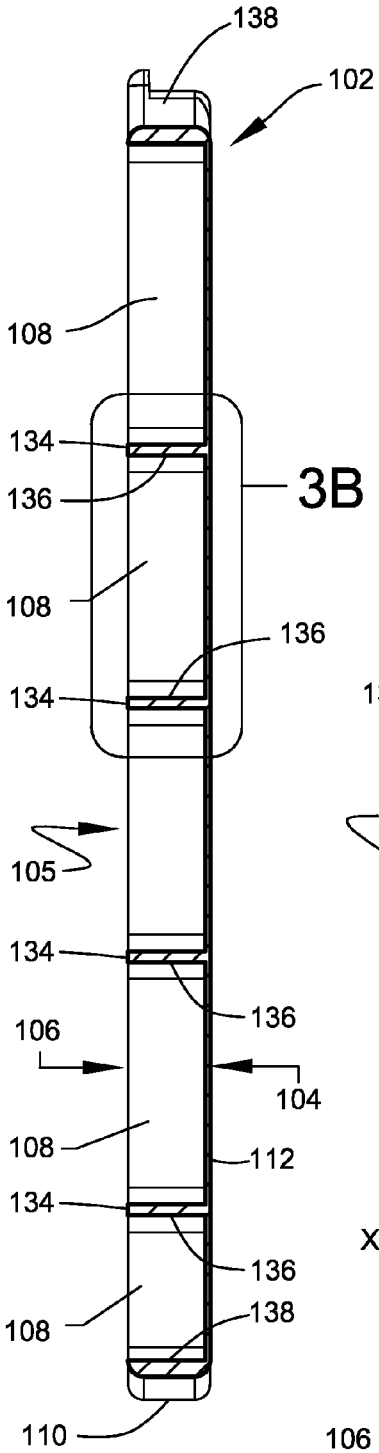
FIG. 3A shows the sectional view 3A-3A of FIG. 2A according to the preferred embodiment of FIG. 1A.
Figure 3B:
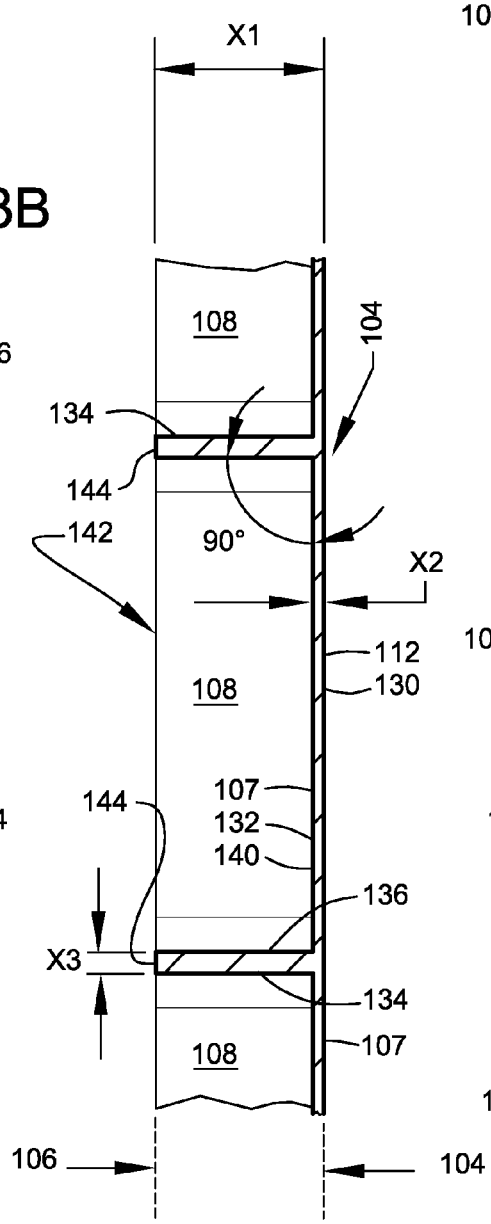
FIG. 3B shows the partial detail view 3B of FIG. 3A, magnified for clarity, according to the preferred embodiment of FIG. 1A.
Figure 4:
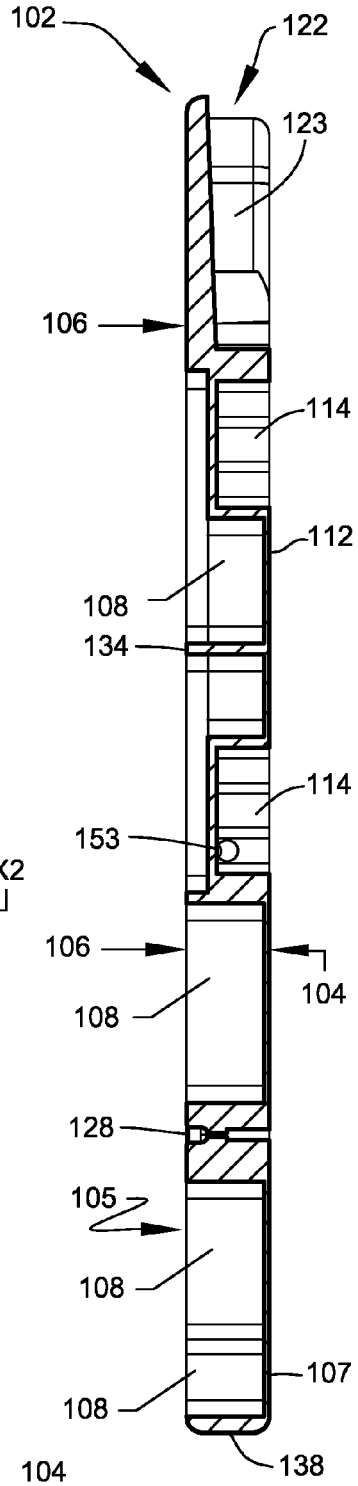
FIG. 4 shows the sectional view 4-4 of FIG. 2A according to the preferred embodiment of FIG. 1A.

FIG. 3A shows the sectional view 3A-3A of FIG. 2A according to the preferred embodiment of FIG. 1. FIG. 3B shows the partial detail view 3B of FIG. 3A, magnified for clarity, according to the preferred embodiment of FIG. 1A. FIG. 4 shows the sectional view 4-4 of FIG. 2A according to the preferred embodiment of FIG. 1A.

Referring to the sectional views, front panel 112 is preferably machined to comprise a thin cross-sectional thickness X2 of less than about ⅛ inch, more preferably, a cross-sectional thickness X2 of about 1/16 inch. Referring to the enlarged detail of FIG. 3B, each integrally-formed panel stiffener 134 preferably comprises a narrow stiffener wall 136 projecting outwardly from inner side 132 of front panel 112, as shown (at least embodying herein wherein each panel stiffener of such plurality of panel stiffeners comprises a stiffener wall projecting outwardly from such at least one inner side of such substantially solid front panel). A majority of stiffener walls 136 are preferably linear in form, as clearly seen in the rear-view illustration of FIG. 2A. Each stiffener wall 136 preferably comprises a preferred minimum cross-sectional thickness X3 of about 1/16 inch. In the depicted preferred embodiment, a majority of the stiffener walls 136 comprises a preferred minimum cross-sectional thickness X3 of about ⅛ inch. It should be noted that some stiffener walls are integrated with thickened rear-body structures, which preferably function to accommodate various body features, such as, apertures, bosses, component pockets, etc. Upon reading this specification, those with ordinary skill in the art will now appreciate that, under appropriate circumstances, considering such issues as design preference, instrument type, structural requirements, available materials, technological advances, etc., other wall thickness arrangements such as, for example, ultrathin walls having cross sectional thicknesses less than 1/16 inch, etc., may suffice.

In the depicted guitar body 102, the plurality of stiffener walls 136 project outwardly in orientations generally perpendicular to the planar front panel 112, as shown. As integrally-formed structure 103 is preferably machined from a one-inch thick blank, the majority of stiffener walls 136 project outwardly the full one-inch thickness (X1) of guitar body 102. Thus, the distal ends 144 of most stiffener walls 136 preferably terminate at the geometric plane defined by rear-body portion 106, as shown.

At least one outer stiffener wall 136 preferably forms a peripheral side-wall 138 inclosing the sides of guitar body 102, as shown. Peripheral side-wall 138 is preferably co-positioned along peripheral-body portion 110, as shown. In the depicted embodiment of the present system, the outer peripheral side-wall 138 is nonlinear and preferably follows the above-described peripheral shape of the guitar body. Peripheral side-wall 138 preferably comprises at least one edge relief. In the present preferred embodiment the edge relief preferably comprises front and back radiuses transitioning peripheral side-wall 138 to front panel 112 and the distal ends 144 of stiffener walls 136 respectively. In addition, peripheral side-wall 138 includes accommodations for guitar components; such components preferably include jack aperture 139 (see FIG. 2B) and a set of strap button apertures 141 to receive a set of guitar strap buttons.

Stiffener walls 136 located within the enclosing peripheral side-wall 138 are preferably arranged in a regular pattern, which preferably generates a regular pattern of open recessed pockets 108. In guitar body 102, the majority of panel stiffeners 134 are preferably arranged along one of two principal wall orientations. In this regard, guitar body 102 comprises a first set of parallel stiffener walls 136A and a second alternately-oriented set of parallel stiffener walls 136B, as shown. In a preferred arrangement, stiffener walls 136B of the second set form angles of about 90-degrees with respect to the parallel stiffener walls 136A of the first set, as shown. In addition, at least one of the first set of parallel stiffener walls 136A or the second set of parallel stiffener walls 136B are preferably aligned substantially parallel with a centrally-located longitudinal body axis 152, as shown. The above-described orthogonal arrangement of stiffener walls 136 preferably generates the pattern of generally rectilinear open recessed pockets 108 visible in the rear views. Upon reading this specification, those with ordinary skill in the art will now appreciate that, under appropriate circumstances, considering such issues as design preference, user preferences, instrument type, cost, structural requirements, available materials, technological advances, etc., other stiffener arrangements such as, for example, diamond-shaped patterns, nonlinear patterns, combinations of linear and nonlinear patterns, designed to transfer specific force loads, wall placements based on identified resonance patterns within a particular instrument body, etc., may suffice.

Individual recessed pockets 108 are preferably bounded on four sides by stiffener walls 136, which preferably functioned as enclosing sidewalls extending substantially between front-body portion 104 and rear-body portion 106, as shown. Each recessed pocket 108 preferably includes a closed end 140, preferably formed by a portion of front panel 112, and an open end 142 preferably co-positioned along rear-body portion 106, as shown.

Through experimentation, open recessed pockets 108 having a pocket width W1 of about ¾ inch and a pocket length L1 of about 3 inches were chosen. To maintain optimum performance, the maximum unsupported length of front panel 112, spanning between stiffener walls 136 at closed end 140, is preferably not more than about 6 inches, when the above-noted aluminum material is utilized.

Applicant's preferred aluminum alloy and pocket configuration was determined to provide an excellent sustain and tone quality. Applicant arrived at the depicted arrangement after experimentation using alternate stiffener sizes and patterns. The preferred depicted design was found to provide reduced a manufacturing time, ideal weight, and unexpectedly, greatly enhanced the sound quality of the assembled guitar.

The above preferred arrangements of guitar body 102 forms a rigid network of supports configured to control resonance within the body, preferably by increasing the overall stiffness of front panel 112 and rigidity of the integrally-formed structure 103 overall. Applicant's preferred arrangement of panel stiffeners 134 also functions to establish primary excitation frequencies of the body. In addition, the above preferred arrangements of guitar body 102 preferably function to control the amplitudes of oscillatory deflections exhibited by the relatively thin front panel 112 when the panel is excited by plucked-string vibrations adjacent outer side 130 (at least embodying herein at least one body-resonance controller structured and arranged to control excitation frequencies and amplitudes of oscillatory deflections exhibited by such substantially solid front panel when such substantially solid front panel is excited by string vibration adjacent such at least one outer side).

As previously noted, stringed-instrument body 101 is preferably structured and arranged to comprise an overall density, by body volume, at least half that of density of constituent material 107 from which the body is constructed. In practice, the subtractive machining producing Applicant's preferred rear-body arrangements removes approximately 70 percent of constituent material 107 from the overall internal body volume 105. This preference produces an instrument body having an ideal weight and balance. Moreover, the resulting rigid and lightweight structure produces an assembled instrument exhibiting exceptional resonance and sustain during play.

Front panel 112 is preferably configured to accommodate various arrangements of electric-instrument hardware. Such electric-instrument hardware may preferably include standard or custom combinations of pickups, control knobs, selector switches, bridges, output jacks, etc. Front panel 112 of the depicted embodiment has been configured to include two (2) recessed pickup receivers 114, three (3) control-knob receiving apertures 116, one (1) switch-receiving aperture 118, and a two-post bridge receiver 120, as shown. Pickup receivers 114 are preferably configurable to receive well-known pickup configurations, including, Humbucker-type pickups, single coils, piezo-based pickups, etc., and/or combinations of the aforementioned pickup devices. In the depicted preferred embodiment, pickup receivers 114 are preferably configured to receive Humbucker pickups. It should be noted that each of the front-located hardware receivers are preferably fitted with an appropriate piece of electric-instrument hardware, thus preferably maintaining the preferred continuous boundary of material co-positioned along front-body portion 104.

The upper portion of front panel 112 preferably comprises a neck-mounting assembly 122 preferably configured to assist mechanically-fastened mounting of at least one stringed-instrument neck 124 to the body (the neck position diagrammatically indicated by the dashed-line depiction of FIG. 1A). Neck-mounting assembly 122 preferably comprises a neck-pocket recess 123 extending through front panel 112 into the body, as shown. In one preferred arrangement, neck-pocket recess 123 comprises four mounting apertures 126, of customary spacing and size, which are preferably provided to accommodate a set of mounting bolts, or screws, preferably used to secure the neck to guitar body 102. Neck-mounting assembly 122 may be selectively configured to accommodate necks of varying designs and differing materials. Neck-mounting assembly 122 is preferably structured and arranged to position the longitudinal neck axis 121 of the stringed-instrument neck 124 in substantially parallel orientation with longitudinal body axis 152, as shown.

Front panel 112 of the depicted embodiment has been further modified to utilize a "string through body" anchoring arrangement. In this preferred configuration, six (6) string apertures 128 are formed within the body to permit the strings to be anchored in place at the back of the guitar body. Upon reading this specification, those with ordinary skill in the art will now appreciate that, under appropriate circumstances, considering such issues as design preference, user preferences, cost, structural requirements, available materials, technological advances, etc., other body arrangements such as, for example, alternate string anchoring arrangements, accommodations for double necks, accommodations for alternate hardware combinations, etc., may suffice.

Referring again to the rear views of FIG. 2A and FIG. 2B, guitar body 102 preferably comprises at least one rear-mounted component receiving pocket 146, as shown (at least embodying herein wherein such stringed-instrument body further comprises at least one component receiver structured and arranged to receive at least one body-mountable electric-instrument component). Component-receiving pockets 146 preferably comprise recessed spaces configured to hold the transducer housings of the control knobs, selector switches, guitar jack, in addition to the associated component wiring. Component-receiving pocket 146 preferably comprises a substantially open end co-positioned along rear-body portion 106, as shown. Preferably, component-receiving pocket 146 further comprises a recessed-cover receiver 148 configured to receive at least one removable cover. Recessed-cover receiver 148 is preferably configured to mount the cover in a generally flush relationship with rear-body portion 106.

Preferably, pickup wiring servicing the electrical componentry is routed through a machined ¼-inch diameter passage 150. Passage 150 preferably extends through the center and along the length of the body and is preferably configured to be in communication with component-receiving pocket 146. Component-receiving pockets 146 are preferably joined by one or more wiring passages 153 preferably configured to permit routing of wiring between component-receiving pocket 146 and passage 150.

Figure 5:
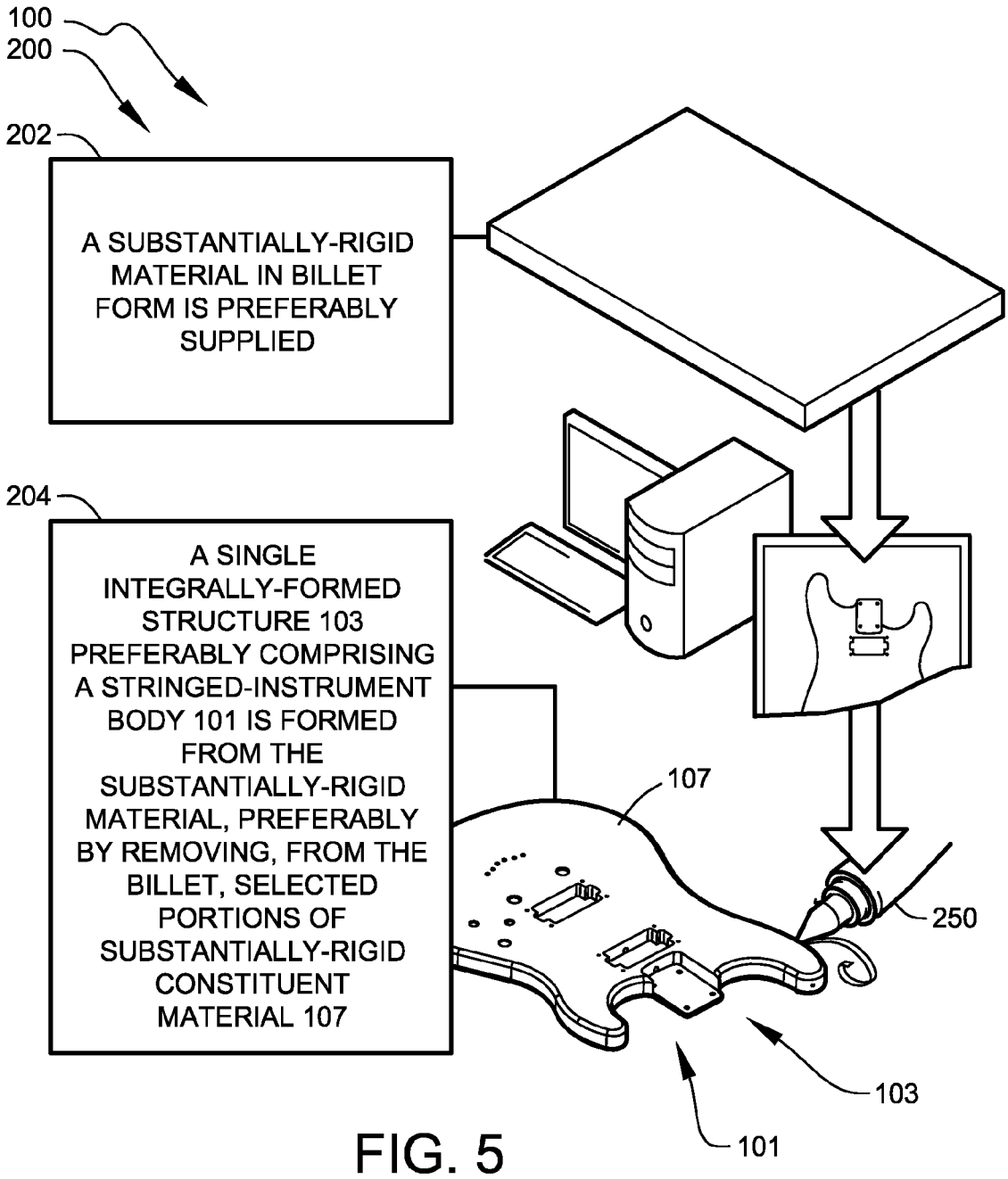
FIG. 5 shows a flow diagram, indicating preferred steps of a preferred method of producing the guitar body, according to a preferred method of the present invention.

FIG. 5 shows a flow diagram, indicating preferred steps of preferred method 200 relating to the formation of stringed-instrument body 101. In that regard, method 200 preferably comprises the following preferred steps. First, as indicated in initial step 202, a substantially-rigid material in billet form is preferably supplied. Next, as indicated in preferred step 204, a single integrally-formed structure 103 preferably comprising a stringed-instrument body 101 is formed from the substantially-rigid material, preferably by removing, from the billet, selected portions of substantially-rigid constituent material 107. The resulting single integrally-formed structure 103 preferably comprises the above-described physical structures and arrangements of stringed-instrument body 101.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A stringed-instrument component system comprising:

a) a stringed-instrument body comprising a single integrally-formed structure;

b) wherein said single integrally-formed structure comprises i) a substantially-rigid body material comprising a substantially-uniform density, ii) at least one front-body portion, iii) spaced apart from said at least one front-body portion, at least one rear-body portion, and iv) at least one peripheral-body portion extending between said at least one front-body portion and said at least one rear-body portion;

c) wherein said at least one front-body portion comprises a substantially solid front panel having at least one outer side and at least one inner side;

d) wherein said at least one inner side comprises at least one body-resonance controller structured and arranged to control excitation frequencies and amplitudes of oscillatory deflections exhibited by said substantially solid front panel when said substantially solid front panel is excited by string vibration adjacent said at least one outer side; and e) wherein a majority of said at least one rear-body portion is structured and arranged to pass essentially all sound energy radiating from said single integrally-formed structure without absorption or reflectance.

2. The stringed-instrument component system according to claim 1 wherein:

a) said at least one front-body portion, said at least one rear-body portion, and said at least one peripheral-body portion together define an internal volume of said stringed-instrument body; and b) said stringed-instrument body is structured and arranged to comprise an overall density, by such internal volume, at least half that of said substantially-uniform density of said substantially-rigid body material.

3. The stringed-instrument component system according to claim 2 wherein said at least one body-resonance controller comprises a plurality of panel stiffeners structured and arranged to increase bending stiffness of said substantially solid front panel.

4. The stringed-instrument component system according to claim 3 wherein each panel stiffener of said plurality of panel stiffeners comprises a stiffener wall projecting outwardly from said at least one inner side of said substantially solid front panel.

5. The stringed-instrument component system according to claim 4 wherein at least two stiffener walls of said plurality of panel stiffeners are configured to intersect.

6. The stringed-instrument component system according to claim 4 wherein said substantially solid front panel comprises:

a) a cross-sectional thickness of less than about ⅛ inch; and b) a maximum unsupported length, spanning between said stiffener walls, of about 6 inches.

7. The stringed-instrument component system according to claim 4 wherein said substantially solid front panel comprises:

a) a minimum cross-sectional thickness of about 1/16 inch; and b) a maximum unsupported length, spanning between said stiffener walls, of less than about 6 inches.

8. The stringed-instrument component system according to claim 4 wherein each said stiffener wall comprises a minimum cross-sectional thickness of about 1/16 inch.

9. The stringed-instrument component system according to claim 4 wherein said stiffener walls are substantially linear.

10. The stringed-instrument component system according to claim 5 wherein said plurality of panel stiffeners comprises:

a) a first set of said stiffener walls and a second set of said stiffener walls;

b) wherein said stiffener walls of said first set comprise substantially parallel wall orientations;

c) wherein said stiffener walls of said second set comprise substantially parallel wall orientations; and d) wherein such substantially parallel wall orientations of said second set form angles of about 90-degrees with respect to such substantially parallel wall orientations of said first set.

11. The stringed-instrument component system according to claim 4 wherein said stringed-instrument body further comprises at least one component receiver structured and arranged to receive at least one body-mountable electric-instrument component.

12. The stringed-instrument component system according to claim 11 wherein said at least one component receiver comprises:

a) at least one component pocket configured to accommodate portions of the at least one body-mountable electric-instrument component;

b) wherein said at least one component pocket comprises at least one open end co-positioned along said at least one rear portion; and c) located at said at least one open end, at least one removable-cover receiver structured and arranged to removably receive at least one cover.

13. The stringed-instrument component system according to claim 4 wherein said stringed-instrument body further comprises at least one neck-mounting assembly structured and arranged to assist mounting of at least one stringed-instrument neck having a longitudinal neck axis.

14. The stringed-instrument component system according to claim 13 wherein said stringed-instrument body further comprises:

a) at least one longitudinal body axis;

b) wherein said at least one neck mounting assembly is structured and arranged to position the longitudinal neck axis of the at least one stringed-instrument neck, when mounted to said stringed-instrument body, in substantially parallel orientation with said at least one longitudinal body axis; and c) wherein at least one of said at least one of first set of said stiffener walls and said second set of said stiffener walls comprises a substantially parallel orientation with respect to said at least one longitudinal body axis.

15. The stringed-instrument component system according to claim 4 wherein at least one portion of each said outwardly-projecting wall intersects said at least one rear-body portion.

16. The stringed-instrument component system according to claim 4 wherein:

a) at least one said outwardly-projecting wall of said plurality of panel stiffeners forms at least one peripheral side-wall a stringed-instrument body; and b) said at least one peripheral side-wall is co-positioned along said at least one peripheral-body portion.

17. The stringed-instrument component system according to claim 1 wherein said substantially-rigid body material comprises rigid composition having a substantially uniform density of between about 0.5 g/cm$^3$ and about 4.5 g/cm$^3$.

18. The stringed-instrument component system according to claim 1 wherein said substantially-rigid body material comprises a metallic composition.

19. The stringed-instrument component system according to claim 18 wherein said metallic composition comprises substantially aluminum.

20. The stringed-instrument component system according to claim 1 wherein said substantially solid front panel is substantially planar.

21. The stringed-instrument component system according to claim 1 wherein said at least one front-body portion and said at least one rear-body portion are spaced apart a distance of about one inch.

22. A stringed-instrument component system comprising:

a) a stringed-instrument body comprising a single integrally-formed structure;

b) wherein said single integrally-formed structure comprises i) at least one front portion, ii) at least one rear portion spaced apart from said at least one front portion, and iii) at least one plurality of open chambers situate between said at least one front portion and said at least one rear portion;

c) wherein said at least one front portion comprises a substantially solid front panel; and d) wherein each said open chamber comprises i) at least one side wall extending substantially between said at least one front portion and said at least one rear portion, ii) adjoining said at least one side wall, at least one closed end formed by at least one portion of said substantially solid front face, and iii) at least one open end co-positioned along said at least one rear portion.

23. A method relating to the formation of a stringed-instrument body comprising the steps of:

a) supplying a substantially-rigid material in billet form;

b) forming within such substantially-rigid material, a single integrally-formed structure comprising a stringed-instrument body by removing selected portions of such substantially-rigid material;

c) wherein such resulting single integrally-formed structure comprises i) at least one front portion, ii) at least one rear portion spaced apart from such at least one front portion, and iii) at least one plurality of open chambers situate between such at least one front portion and such at least one rear portion;

d) wherein such at least one front portion comprises a substantially solid front panel; and e) wherein each such open chamber comprises i) at least one side wall extending substantially between such at least one front portion and such at least one rear portion, ii) adjoining such at least one side wall, at least one closed end formed by at least one portion of such substantially solid front face, and iii) at least one open end co-positioned along such at least one rear portion.

* * * * *